US007237345B2

(12) United States Patent
Thomas

(10) Patent No.: US 7,237,345 B2
(45) Date of Patent: Jul. 3, 2007

(54) DISPOSABLE AND NON-DISPOSABLE FOOT CAP

(76) Inventor: Jeff C. C. Thomas, 9440 N. Meridian St., Indianapolis, IN (US) 46260

( * ) Notice: Subject to any disclaimer, the term of this patent is extended or adjusted under 35 U.S.C. 154(b) by 197 days.

(21) Appl. No.: 10/860,507

(22) Filed: Jun. 4, 2004

(65) Prior Publication Data

US 2005/0022420 A1 Feb. 3, 2005

Related U.S. Application Data

(63) Continuation-in-part of application No. 09/691,921, filed on Aug. 5, 1999, now abandoned.

(51) Int. Cl.
*A43B 5/08* (2006.01)

(52) U.S. Cl. ..... 36/8.1; 36/3 A; 36/51

(58) Field of Classification Search ..... 36/8.1, 36/7.1 R, 51, 3 R, 3 B, 3 A
See application file for complete search history.

(56) References Cited

U.S. PATENT DOCUMENTS 1,771,178 A * 7/1930 Howland ..... 2/68
1,781,842 A * 11/1930 Howland ..... 2/68
1,973,292 A * 9/1934 Littell et al. ..... 36/8.1
2,185,762 A * 1/1940 Cox ..... 36/8.1
2,954,617 A * 10/1960 Yamaguchi ..... 36/11.5
3,324,580 A * 6/1967 Baxter ..... 36/8.1
3,605,292 A * 9/1971 Goldblatt ..... 36/8.1
3,676,940 A * 7/1972 Shively ..... 36/8.1
4,149,274 A 4/1979 Garrou et al.
4,206,514 A 6/1980 Yamauchi
4,215,491 A * 8/1980 Giannetti ..... 36/8.1
4,562,834 A * 1/1986 Bates et al. ..... 602/3
5,371,958 A * 12/1994 Brosseau ..... 36/8.1
5,473,788 A * 12/1995 Aragona ..... 15/104.92
5,771,610 A 6/1998 McDonald
5,778,702 A 7/1998 Wrightenberry
5,799,333 A 9/1998 McGarry et al.

* cited by examiner

*Primary Examiner*—Marie Patterson
(74) *Attorney, Agent, or Firm*—Baker & Daniels LLP

(57) ABSTRACT

Thin, lightweight footwear made of a polyethylene material that is composed of a top part and a sole part that are sewn together such that when fitted properly to the wearer's foot the footwear encompasses the foot and extends to the level of the ankle. The top part is porous allowing the ingress and egress of soap and water. The sole has slip resistance properties due to the material from which it is made and the texture of its outer surface. The finished product can be folded and compressed for storage, then later unfolded and worn without the folding adversely affecting its intended function of providing a barrier between the wearer's feet and the tub or shower floor on which the wearer stands while the wearer showers.

20 Claims, 4 Drawing Sheets

DISPOSABLE AND NON-DISPOSABLE FOOT CAP

This is a Continuation-In-Part of application Ser. No. 09/691,921 filed Aug. 5, 1999, now abandoned.

BACKGROUND OF THE INVENTION

This invention relates to shower footwear articles worn on the feet by persons as a means to reduce the risks of contracting athlete's foot, plantar warts and other pathological conditions of the feet secondary to using away from home showers.

SUMMARY OF THE INVENTION

Due to the abundance of material related to health care and the easy access to this information, many individuals have become more conscientious about their personal health and on maintaining it. One concern that is significantly important to people who frequent fitness centers, travel, or work in industrial settings, is the maintenance of disease-free feet when using on site shower facilities. The objective is to avoid contracting foot problems such as athlete's foot and plantar warts. The usual approach is to create a barrier between the feet and the floor of the shower or tub. Barriers have included bath towels placed on the floor, socks or regular shoes worn in the shower, and more commonly, sandals and similarly configured footwear worn in the shower. Regarding the items mentioned above, one might consider any of those items to be relatively bulky and quite cumbersome to carry around just for the purpose of using when in the shower.

Given the above discussion, it would be quite convenient to have at one's disposal a foot cover designed specifically as a prophylaxis against contracting athlete's foot, plantar warts, or other pathologic conditions of the feet as a result of using an away from home showering facility. The invention would perform as a foot cover to be worn in the shower. Feet could be washed effectively during the showering process without having to remove the article from the feet. The invention would have a slip-resistant sole as a safety feature to reduce the risk of slips and falls in the shower. Instead of creating an add-on attachment to provide slip-resistance, the sole itself would be made of a specially processed polyethylene material manufactured in such a way that a high coefficient of friction is created between the sole or bottom of the invention and the wet or dry shower floor surface as the wearer is showering.

Another favorable characteristic of the invention is that it be low in weight (lightweight) and non-rigid or compressible, such that it is easily foldable. That is to say—easily foldable and lightweight in the same manner as a current-day, inexpensive, thin, disposable, plastic showercap. This characteristic would allow the invention to be compressed, folded, and placed in a small compartment such as shirt or pants pocket, or in a small space inside of a travel bag or standard-sized purse. The invention would be, in essence, an "ultra-lightweight" showercap for the foot—resembling a disposable showercap in structure, weight, and compressibility.

In Summary, the invention proposed here in this document is an article of footwear to be worn in the shower: It is ultra-lightweight and compressible for easy portability, fits the foot like a bootie, has a slip-resistant sole, and allows each foot to be thoroughly cleansed without removing the item from the foot while showering.

BRIEF DESCRIPTION OF THE DRAWINGS

The following is a summary of the drawings and will serve to further clarify the characteristics of the invention in which.

DETAILED DESCRIPTION OF THE INVENTION

Note: The terms "footwear" or "invention" are used interchangeably throughout this document and both terms refer to the same thing—the invention.

Figure 1:
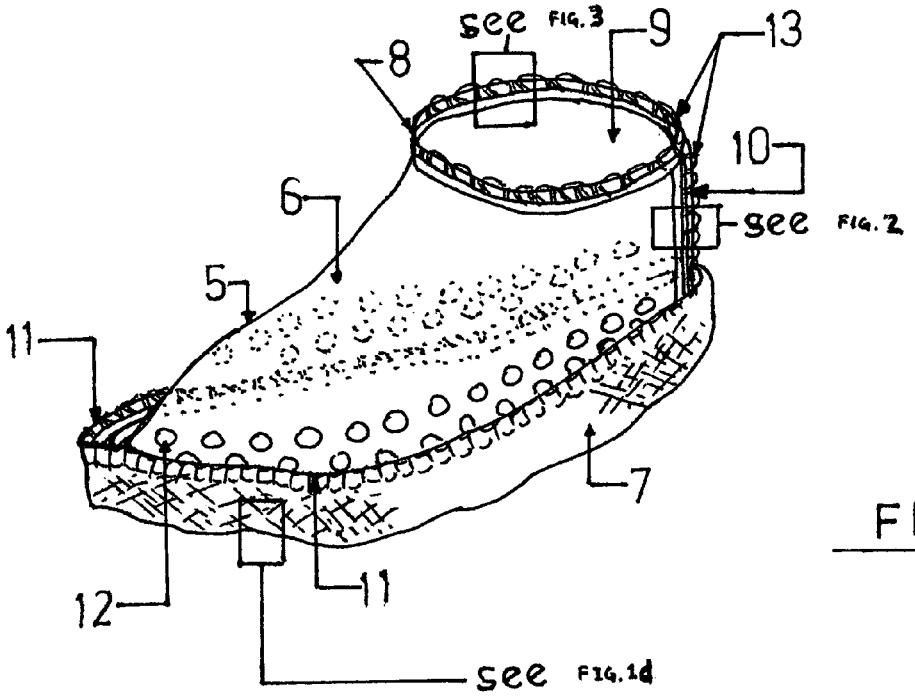
FIG. 1 is a side elevation of the shower footwear invention 5.
Figure 1A:
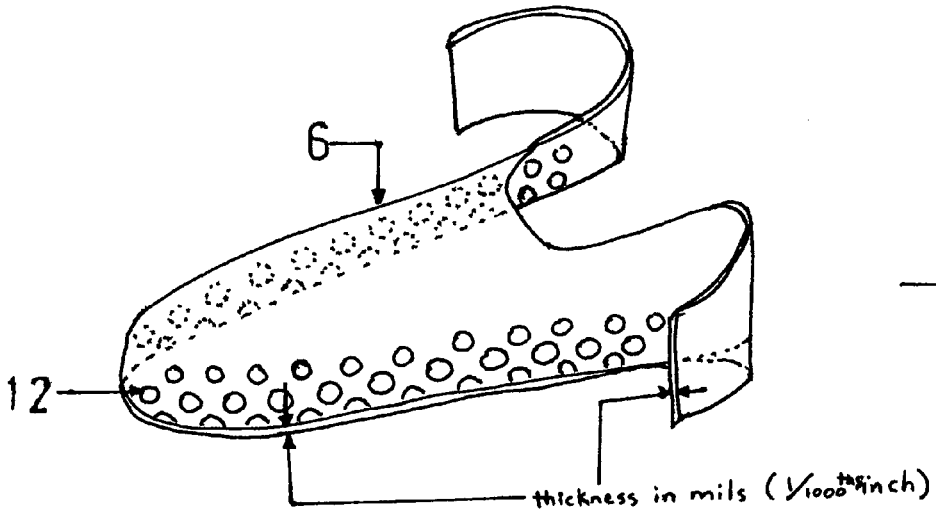
FIG. 1*a* is preformed representative of a side elevation view of top component 6 interrupted posteriorly, thus forming non-confluent flaps in the back. The figure reflects top component 6 prior to assembly into footwear invention 5.
Figure 1B:
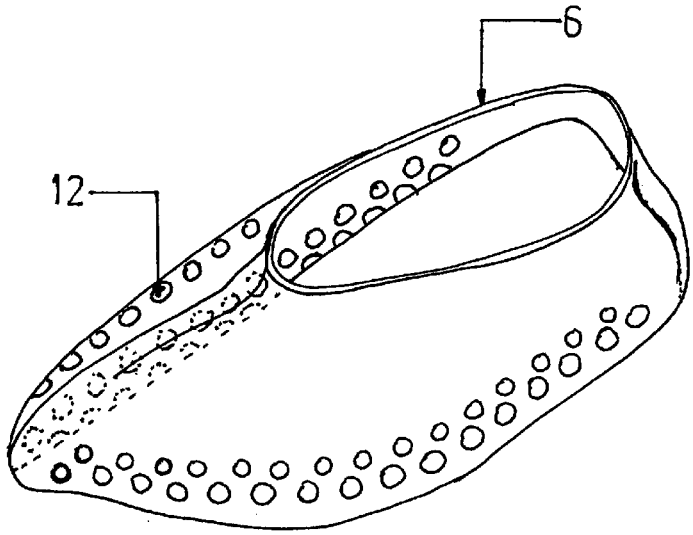
FIG. 1*b* is an alternative representative of a side elevation view of top component 6 circumferentially confluent and without interruption in the back. This figure reflects an alternative configuration of top component 6 prior to assembly into footwear invention 5.
Figure 1C:
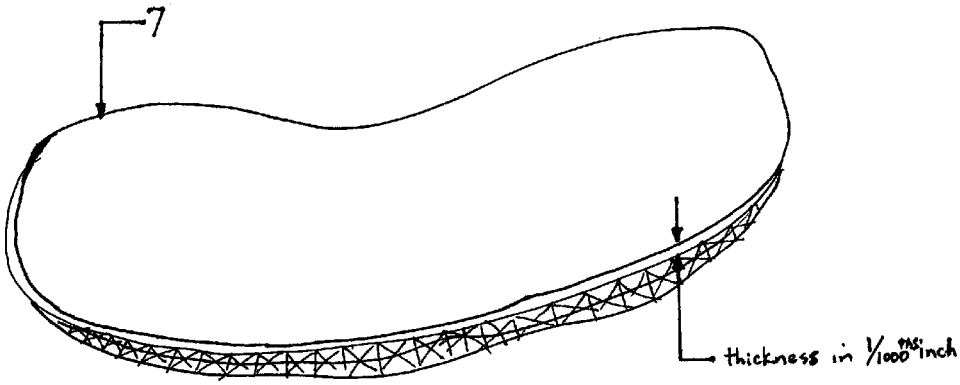
FIG. 1*c* is a side view of bottom component 7 prior to assembly into footwear invention 5.
Figure 1D:
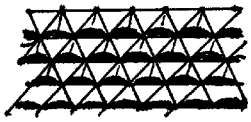
FIG. 1*d* is an exploded view of a section of the outside surface of bottom component 7 illustrating one of several patterns or textures on the outside surface. The purpose of the pattern is to provide additional slip-resistance.
Figure 2:
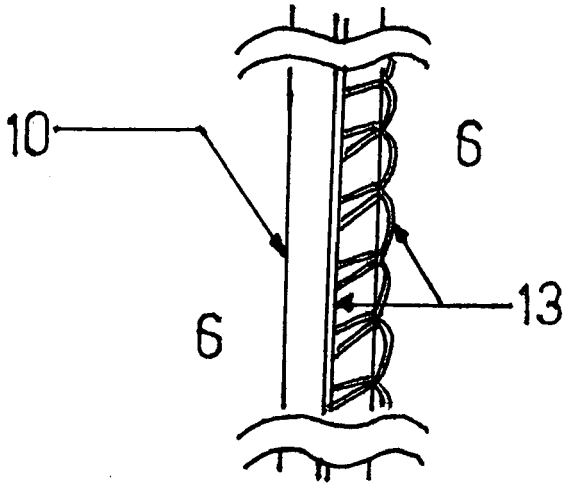
FIG. 2 is an exploded view of a section demonstrating a manner of attachment of elastic component 10 to top component 6 via stitching 13.
Figure 3:
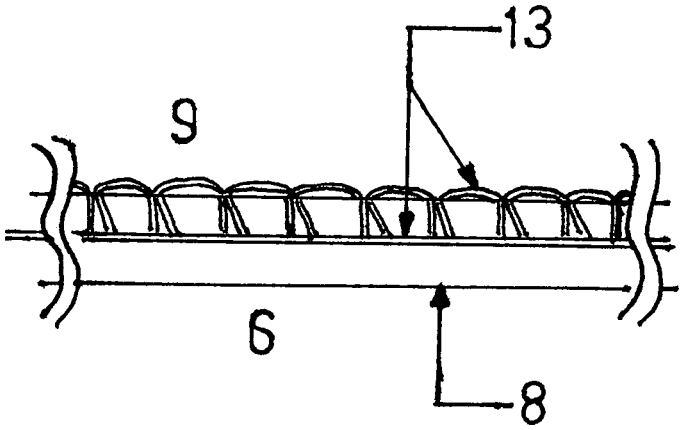
FIG. 3 is an exploded view of a section demonstrating a manner of attachment of elastic component 8 to top component 6 via stitching 13 to form opening 9. (Similarly done is the attachment of elastic component 11 to top component 6 and bottom component 7 via stitching 13).
Figure 4:
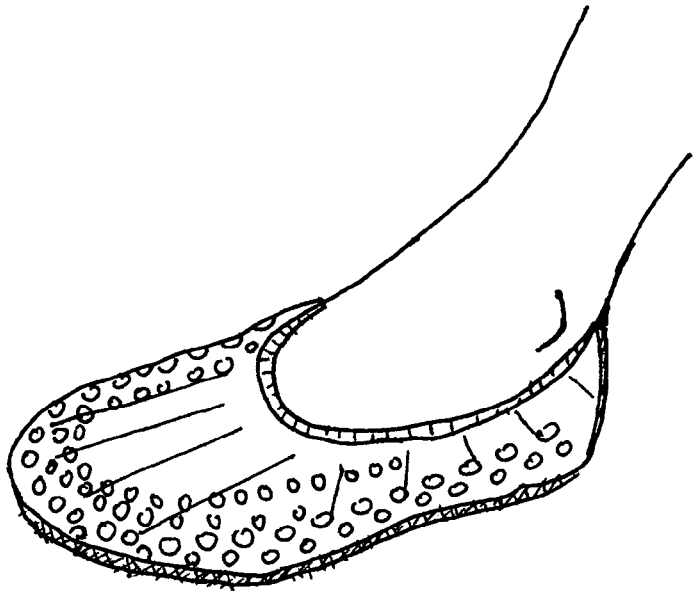
FIG. 4 provides two (2) perspective views of the invention 5 as it would appear on a foot. Note: The configuration of the stitching 13 may vary from that shown in the figures as long as it serves its purpose of attaching the components and elastic materials together to create invention 5, while preserving the form and function of invention 5.
Figure 4:
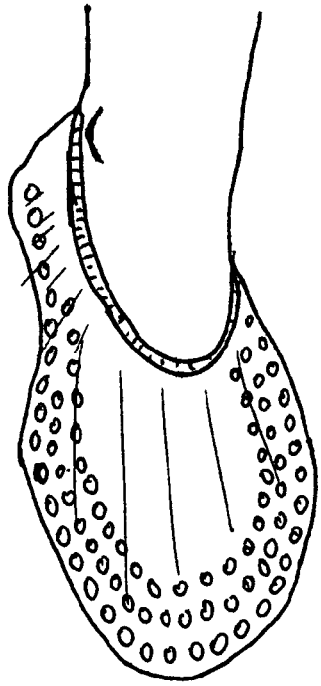

With reference to FIG. 1, the shower footwear, according to the present invention is shown therein and denoted by numeral 5. Footwear 5 has a top component 6 which has multiple discrete holes 12 in it for the ingress and egress of soap and water, a non-porous sole or bottom component 7, an elastic component 8 which is directly attached to top component 6 to form an expandable opening 9. Opening 9 receives the wearer's foot. Elastic component 10 is attached posteriorly to component 6 via stitching 13. Elastic component 10 extends vertically along top component 6 and intersects elastic component 8 above down to bottom component 7 and elastic component 11 below. The attachments are created via stitching 13. Elastic component 11 is integrated with top component 6 and bottom component 7 via stitching 13, circumferentially, and in the plantar plane—along the front, sides, and back of footwear 5. Elastic component 10 may be incorporated into the finished product as shown in FIG. 1 using top component 6 (as shown in FIG. 1*a*). Attachments are made via stitching 13. Elastic component 10 could be excluded from invention 5 if the alternative top component 6 (as shown in FIG. 1*b*) is used. The alternative top component 6 is not interrupted in the back, thus no stitching is needed posteriorly along top component 6. Excluding elastic component 10 will not change form or function, and may provide a costs savings in manufacturing invention 5.

At present the incorporation of elastic component 10 in invention 5 may provide a small amount of stretch in the back of footwear 5 along the heel of the wearer, and may minimize the pulling off of the posterior aspect of footwear 5 from the heel of the wearer should a forward directed shearing force be applied to sole 7 when footwear 5 is on the wearer's foot. Alternatives to stitching 13 as a means of securing the components of invention 5 to each other include the use of adhesive bonding, temperature or friction bonding, stapling, zippers (where possible) or other fastening methods that provide the same form, function and chief characteristics as outlined in this document. Top component 6 contains multiple strategically placed holes that allow the ingress and egress of soap and water through the multiple holes 12. The wearer can wash the foot with footwear 5 remaining on the foot during the showering process.

With reference to FIG. 1, elastic component 8 provides opening 9 with stretching capability to accommodate insertion of a foot into opening 9. Once the foot is inserted, elastic component 8 provides contraction around the ankle or foot to help keep footwear 5 on the wearer's foot. In FIG. 1, elastic component 8 is attached to top component 6 via stitching 13 to form opening 9.

The invention also allows for other means of attaching elastic component 8 to top component 6 to form opening 9. Examples of alternatives to stitching 13 to attach the individual components of the invention 5 to each other are mentioned above.

With reference to FIG. 1, top component 6 is attached to bottom component 7, circumferentially and in the plantar plane by elastic component 11. Top component 6 and bottom component 7 are secured to each other along their edges along with elastic component 11 via stitching 13. Slack is introduced along the joined edges of top component 6 and bottom component 7, in the plantar plane. Top component 6 and bottom component 7 are attached to elastic component 11 via stitching 13. Expansion and recoil in the plantar plane is provided by elastic component 11. Alternatives to using stitching 13 are mentioned above.

While preferred embodiments of the present invention have been described, it will be appreciated by those of ordinary skill in the art that certain modifications may be made without departing from the scope of the present invention. All such modifications are intended to come within the scope of the claims which follow:

What is claimed is:

1. A shower footwear to be worn during showering with soap and water for covering a user's foot and providing a barrier between the user's foot and a floor surface, the shower footwear including:

an upper component adapted to cover an upper surface of the user's foot, the upper component including an expandable opening adapted to receive the user's foot, the upper component including a first component made of a non-rigid plastic having a plurality of apertures therethrough to allow the ingress and egress of the soap and the water and a first elastic component coupled to the first component, the first elastic component forming the elastic expandable opening;

a bottom component adapted to provide the barrier between the user's foot and the floor surface; and a second elastic component extending around a circumference of the upper component, the second elastic component coupling the upper component to the bottom component.

2. The shower footwear of claim 1, wherein the second elastic component is coupled to the upper component and the bottom component by one of stitching, adhesive bonding, temperature bonding, friction bonding, stapling, and zippers.

3. The shower footwear of claim 1, wherein a bottom surface of the bottom component includes a slip-resistant surface.

4. The shower footwear of claim 1, wherein at least one of the upper component and the bottom component are constructed of a polyethylene material.

5. The shower footwear of claim 1, wherein the upper component is coupled to a vertically extending elastic component positioned adjacent to a heel portion of the upper component.

6. The shower footwear of claim 1, wherein the upper component and the bottom component cooperate to cover the entire foot and the upper component extends to a level of an ankle of the user.

7. A shower footwear to be worn during showering for covering a user's foot and providing a barrier between the user's foot and a floor surface, the shower footwear including:

an upper component adapted to cover an upper surface of the user's foot, the upper component including an elastic expandable opening adapted to allow insertion and removal of the user's foot;

a vertically extending elastic component coupled to the upper component and positioned adjacent to a heel portion of the upper component; and a bottom component coupled to the upper component, the bottom component adapted to provide the barrier between the user's foot and the floor surface.

8. The shower footwear of claim 7, wherein the upper component includes a plurality of apertures positioned around a lower perimeter of the upper component.

9. The shower footwear of claim 7, wherein the upper component is coupled to the bottom component by one of stitching, adhesive bonding, temperature bonding, friction bonding, stapling, and zippers.

10. The shower footwear of claim 7, wherein the upper component includes a plurality of apertures extending therethrough.

11. The shower footwear of claim 7, wherein a bottom surface of the bottom component includes a slip-resistant surface.

12. The shower footwear of claim 7, wherein at least one of the upper component and the bottom component are constructed of a polyethylene material.

13. The shower footwear of claim 7, wherein the upper component includes a first component made of a non-rigid plastic and a first elastic component coupled to the first component, the first elastic component forming the elastic expandable opening.

14. The shower footwear of claim 13, wherein the first component of the upper component includes a plurality of apertures extending therethrough.

15. The shower footwear of claim 7, wherein the upper component and the bottom component cooperate to cover the entire foot and the upper component extends to a level of an ankle of the user.

16. A shower footwear to be worn during showering for covering a user's foot and providing a barrier between the user's foot and a floor surface, the footwear including:

an upper component adapted to cover an upper surface of the user's foot, the upper component including an elastic expandable opening adapted to allow insertion and removal of the user's foot, the upper component having a plurality of apertures extending therethrough;

a vertically extending elastic component coupled to the upper component and positioned adjacent to a heel portion of the upper component; and a bottom component coupled to the upper component, the bottom component adapted to provide the barrier between the user's foot and the floor surface, the bottom component including a bottom slip resistant surface.

17. The shower footwear of claim 16, wherein the vertically extending elastic component is coupled to the upper component by stitching.

18. The shower footwear of claim 16, wherein the vertically extending elastic component is coupled to the upper component by means for securing the vertically extending elastic component to the upper component.

19. The shower footwear of claim 16, wherein the upper component includes a first component having the plurality of apertures extending therethrough and made of a non-rigid plastic and a first elastic component coupled to the first component, the first elastic component forming the elastic expandable opening.

20. The shower footwear of claim 16, wherein the upper component and the bottom component cooperate to cover the entire foot and the upper component extends to a level of an ankle of the user.

* * * * *